US006492776B2

(12) United States Patent
Rutherford

(10) Patent No.: US 6,492,776 B2
(45) Date of Patent: Dec. 10, 2002

(54) METHOD FOR DRIVING A PLASMA DISPLAY PANEL

(76) Inventor: James C. Rutherford, 1811 Billy Dr., Fort Wayne, IN (US) 46802

( * ) Notice: Subject to any disclaimer, the term of this patent is extended or adjusted under 35 U.S.C. 154(b) by 27 days.

(21) Appl. No.: 09/838,504

(22) Filed: Apr. 19, 2001

(65) Prior Publication Data

US 2002/0047584 A1 Apr. 25, 2002

Related U.S. Application Data

(60) Provisional application No. 60/201,072, filed on Apr. 20, 2000.

(51) Int. Cl.[7] ..... G09G 3/28

(52) U.S. Cl. ..... 315/169.1; 315/169.3; 345/60; 345/67; 345/68

(58) Field of Search ..... 315/169.1, 169.3; 345/60, 67, 68

(56) References Cited

U.S. PATENT DOCUMENTS

| | | | | |
|---|---|---|---|---|
| 5,541,618 | A | 7/1996 | Shinoda | |
| 5,745,086 | A | 4/1998 | Weber | |
| 5,877,734 | A | 3/1999 | Amemiya | |
| 5,903,245 | A | 5/1999 | Shimizu et al. | |
| 6,020,687 | A | 2/2000 | Hirakawa et | |
| 6,292,160 | B1 * | 9/2001 | Mikoshiba et al. | 345/60 |

FOREIGN PATENT DOCUMENTS

| | | |
|---|---|---|
| EP | 0488326 B1 | 3/1996 |
| EP | 0938073 A2 | 2/1999 |
| EP | 0965975 A1 | 6/1999 |
| EP | 0959451 A2 | 11/1999 |
| WO | 00/03379 | 12/2000 |

OTHER PUBLICATIONS

G.S. Lim "Asia Display 98" pp. 591–594.
Ilhun Son "EuroDisplay 99" pp. 73–76.

* cited by examiner

*Primary Examiner*—David Vu
(74) *Attorney, Agent, or Firm*—George Pappas

(57) ABSTRACT

The plasma display panel (PDP) cells are defined at the cross points of the electrodes and sustain discharges are provided in the cells by changing electrical potential of the sustain/scan and sustain electrodes with respect to one another. The sustain/scan and sustain electrodes are driven simultaneously substantially at opposite phase and between low and high electrical potentials with respect to one another thereby substantially eliminating electrical potential pulses from being induced on the data electrodes. Preferably, the PDP is divided into a plurality of display areas which are electronically independently controlled. Because electrical potential pulses are not induced in the data electrodes, in operation, while one display area is being addressed the remaining panel display areas are in sustain mode providing discharge pulses and producing light emissions.

11 Claims, 16 Drawing Sheets

Note: SW25 and SW26 are complementary signals

METHOD FOR DRIVING A PLASMA DISPLAY PANEL

BACKGROUND OF THE INVENTION

Applicant hereby claims priority of provisional U.S. application Ser. No. 60/201,072 filed Apr. 20, 2000.

FIELD OF THE INVENTION

The present invention relates to a method for driving plasma display panels (PDP) which are used as display terminals for television sets and computers.

DESCRIPTION OF THE BACKGROUND ART

A plasma display panel (referred to as "PDP" hereinafter) is a device which displays letters or pictures by using light emitted from plasma generated during gaseous discharge. The PDP is classified into a DC-type and an AC-type depending on a driving method for providing an electric field thereto in order to make the plasma.

Since the PDP has advantageous characteristics such as large screen size of more than 40 inches, ability to display full-color images and wide viewing angle compared with other flat panel devices, it results in a rapid increase in its application area such as next generation high definition televisions (HDTV) capable of hanging on the wall and a multimedia display apparatus combining a TV and a personal computer.

There are several methods for driving the AC-type PDP. One of the methods is disclosed in U.S. Pat. No. 5,541,618, assigned to Fujitsu Limited. An Address Display period Separated (ADS) sub-field method is disclosed and used for driving the PDP in this patent. In accordance with this patent, one image frame is divided into n number of subframes. Each of the subframes includes: an addressing period subsequently providing scan pulses to all scan electrodes in order to indicate cells to be lit; and a display period having a predetermined sustain pulses and concurrently applying sustain pulses to all the scan electrodes, wherein a number of the sustain pulses is predetermined differently for each subframe. The scan pulses are continuously provided onto all the scan electrodes and address pulses are applied onto data electrodes in response to picture data to be displayed. However, according to the ADS sub-field method, since every subframe should have an addressing period for addressing all the scan lines, the display period is relatively shortened. Therefore, the brightness of an image may be decreased.

In order to prevent users from seeing flickers on the screen, the time for controlling illumination of one frame should be limited to about 1/60 sec or less, namely 16.67 ms. In the NTSC system having 480 scan lines, if one image frame is divided into 8 number of subframes, it takes about 11 to 12 ms in addressing one image frame. Because the remaining time for the display period which TV viewer can substantially recognize the image is only 5 to 6 ms, the efficiency becomes only 30% and the brightness of the image is reduced. However, if increasing frequency of sustain pulse in order to compensate the brightness reduction, power consumption is increased and reliability of driving is also decreased.

In the case of HDTV having 1024 scan lines, because it takes about 24 to 25 ms in addressing one image frame, there is not enough remaining time for the display period. As a result, the TV viewer cannot recognize the image. Also, since pixels corresponding to scan electrodes are continuously selected for an addressing period, the reliability of driving is reduced by a result of static delay effect, which occurs in discharge firing.

One specific driving method for ADS is disclosed in EP patent No. 0,965,975A1 "Method and apparatus for driving plasma display panel". A plasma display panel using this method has a plurality of first electrodes and second electrodes arranged parallel to each other, a plurality of third electrodes arranged to cross the first and second electrodes, and discharge cells defined within the areas in which the third electrodes cross the first and second electrodes. The electrodes are thus mutually arranged in the form of a matrix. According to a driving method for such a plasma display panel, a reset period is a period during which the distribution of wall charges in the plurality of discharge cells is uniformed. An addressing period is a period during which wall charges are produced in the discharge cells according to display data. A sustain discharge period is a period during which sustain discharge is induced in the discharge cells in which wall charges are produced during the addressing period. The driving method comprises a step of applying a first pulse as shown in prior art FIG. 3 ($-V_{wx}$, $V_{wy}$) in which an applied voltage varies with time so as to induce first discharge in the lines defined by the first and second electrodes, and a step of applying a second pulse ($V_{ex}$, $-V_{ey}$) in which an applied voltage varies with time so as to induce second discharge as erase discharge in the lines defined by the first and second electrodes. These steps are carried out during the reset period.

FIG. 1 is a schematic diagram showing the structure of a surface discharge type PDP. FIG. 2 is a waveform diagram illustrating an ADS driving method implemented in the PDP shown in FIG. 1. During the addressing period, addressing discharge is induced by applying a scanning pulse successively to the Y electrodes. A voltage Vx is, conventionally applied to the X electrodes that are paired with the Y electrodes, to which the scanning pulse has been applied, to define display lines. Consequently, addressing discharge is induced. In contrast, a voltage −Vux is applied to X electrodes defining non-display lines. A potential difference from the Y electrodes is thus limited in order to prevent addressing discharge from being induced in the non-display lines. The scanning pulse is applied successively to the odd-numbered Y electrodes in order to induce addressing discharge. Thereafter, the scanning pulse is applied successively to the even-numbered Y electrodes in order to induce addressing discharge. This procedure is the same as that in the conventional method and is commonly referred to as a selective write method.

A second specific driving method for ADS is disclosed in U.S. Pat. No. 6,020,687 wherein a method for driving a plasma display panel includes carrying out an erase address operation when a display on the screen is renewed. The erase address operation includes the steps of carrying out an address preparation operation for producing the wall charge in all the discharge cells through a first step of generating a discharge only in a discharge cell in an ON-state, and a second step of generating a discharge only in a discharge cell in an OFF-state, and carrying out an operation for selectively erasing the wall charge in a discharge cell other than a discharge cell corresponding to data of the image to be displayed. FIG. 3 shows exemplary waveforms for voltage pulses applied to the electrodes by this erase address method. The pulse for the erase address discharge (a voltage pulse synthesized from an address pulse applied to the address electrode and a scan pulse applied to the scan electrode) is applied to create an address discharge only in non-selected cells to remove the stored wall charge. Accordingly, the sustain discharge does not occur later in these cells. This method is commonly referred to as the selective erase method in the industry.

Another method for driving the PDP is Address While Display (AWD). There have been proposed many PDP driving methods that use the AWD method, such as in the article by Lim G. S. "New Driving Method for Improvement of Picture Quality in 40-inch AC PDP" Asia Display 98 pp. 591–594. In that article they adapted the new driving method to improve the picture quality that is called Distributed-Address and Sustain (DAS) method. This technique is different from the current ADS method. The address period and display period is not separated so the problem which reduces the light-emitting time in traditional ADS method is solved.

FIG. 4 shows the driving waveforms and timing diagrams, which were applied to the DAS method. The DAS method has a poor contrast ratio because the addressing method used is a non-selective write pulse followed by a selective erase pulse. Both pulses produce light output that is not part of picture data, therefore, resulting in a poor contrast ratio. Also, the time for line scan addressing during a free time is reduced. This is caused by loss of addressing time during the sustain pulse period.

A second driving method using AWD is described in the article "Multiple Addressing in Single Sustain Method: A New High Speed Driving Scheme for ac-PDP" EuroDisplay '99 pp. 73–76. This Multiple Addressing in Single Sustain (MASS) method is introduced as a new high speed addressing scheme for AC-PDP. Since the multiple lines are addressed in a single sustain period while the sustain voltage is applied, the wall charge accumulation time is longer than the write pulse period enabling the high speed addressing. The exponential ramp erase waveform possible with MASS driving is found very effective to increase the operating margin and improve the picture quality.

The driving pulse waveforms of MASS are shown in FIG. 5. A group of scan lines are addressed in a single discharge period, Ts. The setup period which consists of priming and reset discharge is put only once at the start of a frame field followed by the sustain pulses without separate addressing period as in ADS. The addressing takes place after the transition of sustain pulse voltage with the scan (Y) electrode voltage settled at lower sustain voltage level, $V_{s-}$. While the negative scan pulses of $V_W$ are applied to the selected scan lines at the addressing period $T_A$, the positive addressing pulses of $V_A$ are synchronously applied to the addressing (or data) electrodes in correspondence with the image data. The scan lines selected during the same sustain period receive the erase pulse simultaneously as the subfield periods are same for these lines. Since the write discharge is triggered with the DC level of sustain voltage ($Vs=V_{s+}-V_{s-}$) applied between the X-Y electrodes of front plate, the wall charge formation process continues even after the write pulse until the next sustain pulse transition occurs.

One of the major problems the MASS driving method has is in the data drive. The data driver must be returned to ground during the sustain transitions, resulting in a higher duty cycle. Thus, the power dissipation in the device is increased. Also, $V_A$ applied to the data driver IC is twice that of other drive schemes.

In summary, the most commonly used drive method is address display separate (ADS), used by Fujitsu and others. ADS driving has been widely adopted for its simple architecture and low discharge failure rate. However, as the number of display rows increase to do higher resolution displays, such as in HDTV, ADS driving becomes less effective since the required increased addressing period that would be required for the increase in the number of rows would leave little of the frame period for sustain pulses. With less time for sustain pulses in a frame period the maximum brightness that the display can obtain is reduced. If the sustain pulse width is reduced to increase the number of sustain discharges to increase brightness then the luminous efficiency is reduced. Typically on lower resolutions displays (480 rows) ADS uses three fourths of the frame period for addressing and one fourth for sustain discharges to produce the light emissions. This limits the number of rows that can be scanned and addressed per frame. The small period of the frame time used for sustain discharge pulses allows for only a finite number of sustain pulses, therefore the brightness of the display is limited. A drawback of the address while display (AWD) method is that in this scheme during sustain transitions there is no addressing. Therefore, the number of rows scanned and addressed is limited. Also, having the sustain and addressing waveforms as one results in compromises in the address drive.

In all prior PDP driving methods, however, all sustain discharges between the X & Y electrodes are conducted at discretely different time periods from the time periods during which the PDP cells are being addressed. This is because, during the sustain discharges, a potential would be induced onto the addressing electrodes thereby causing faults and preventing accurate addressing.

SUMMARY OF THE INVENTION

An object of the present invention is to overcome the limitations of the two drive methods that are currently being used to drive plasma display panels.

The new drive method in accordance with the principles of the present invention is Address Display Together (ADT). This method overcomes the above limitations in plasma display panel drives. In this scheme, the PDP is divided into blocks which are driven by independent controlled drive electronics. In operation, in one block or display area the cells are addressed while, simultaneously, in the remaining blocks or display areas the cells are sustained creating discharges and producing light emissions. The scan and sustain (X & Y) electrodes in the sustain blocks are driven simultaneously at opposite phase and between low and high potentials with respect to one another. Accordingly, although sustain discharges are produced in the cells of the sustain blocks, substantially no electrical potential is induced on the address or data electrodes. This makes possible for one block to have addressing waveforms while the remainder of the blocks have conditioning waveforms or sustain discharge pulses producing light emissions. Therefore, during a frame period there is almost 100% address time. The time for sustain discharge pulses is increased by a minimum of three times when compared to that of the ADS method.

In one form thereof the present invention is directed to a method of driving a plasma display panel having a plurality of pairs of first and second electrodes arranged parallel with one another. Third electrodes are arranged generally orthogonal to the first and second electrodes. A plurality of cells are defined at cross points of the electrode pairs and third electrodes. Sustain discharges are provided in the cells by changing the electrical potential of the first and second electrodes with respect to one another. The method includes the steps of simultaneously driving the first and second electrodes of at least one pair between low and high electrical potentials with respect to one another, whereby sustain discharges are provided at one or more cells of the one pair and substantially no electrical potential is induced on the third electrodes.

In one form thereof the present invention is directed to a method of driving a plasma display panel having a plurality of pairs of first and second electrodes arranged parallel with one another. Third electrodes are arranged generally orthogonal to the first and second electrodes. A plurality of cells are defined at the cross points of the electrode pairs and the third electrodes. Sustain discharges are provided in the cells by changing the electrical potential of the first and second electrodes with respect to one another. The method includes the steps of simultaneously driving the first and second electrodes of at least one pair substantially at opposite phase and between low and high electrical potentials with respect to one another, whereby sustain discharges are provided at one or more cells of the one pair and substantially no electrical potential is induced on the third electrodes.

In one form thereof the present invention is directed to a method of driving plasma display panels having a plurality of pairs of first and second electrodes arranged parallel with one another. Third electrodes are arranged generally orthogonal to the first and second electrodes and a plurality of cells are defined at cross points of the electrode pairs and the third electrodes. Electrical potential is placed on the first or second electrodes for conditioning the cells for thereafter addressing with the third electrodes. The method includes the steps of conditioning cells of at least one pair by placing electrical potential on the first or second electrodes of the one pair and, while conditioning the cells of the one pair, placing an electrical potential on the third electrodes whereby address charges are placed on cells of another pair of electrodes.

BRIEF DESCRIPTION OF THE DRAWINGS

The above mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DESCRIPTION OF THE PREFERRED EMBODIMENTS

The following is an explanation of the preferred embodiments of the invention constructed and operated in accordance with the principles of the present invention and with reference to the drawings.

Figure 1:
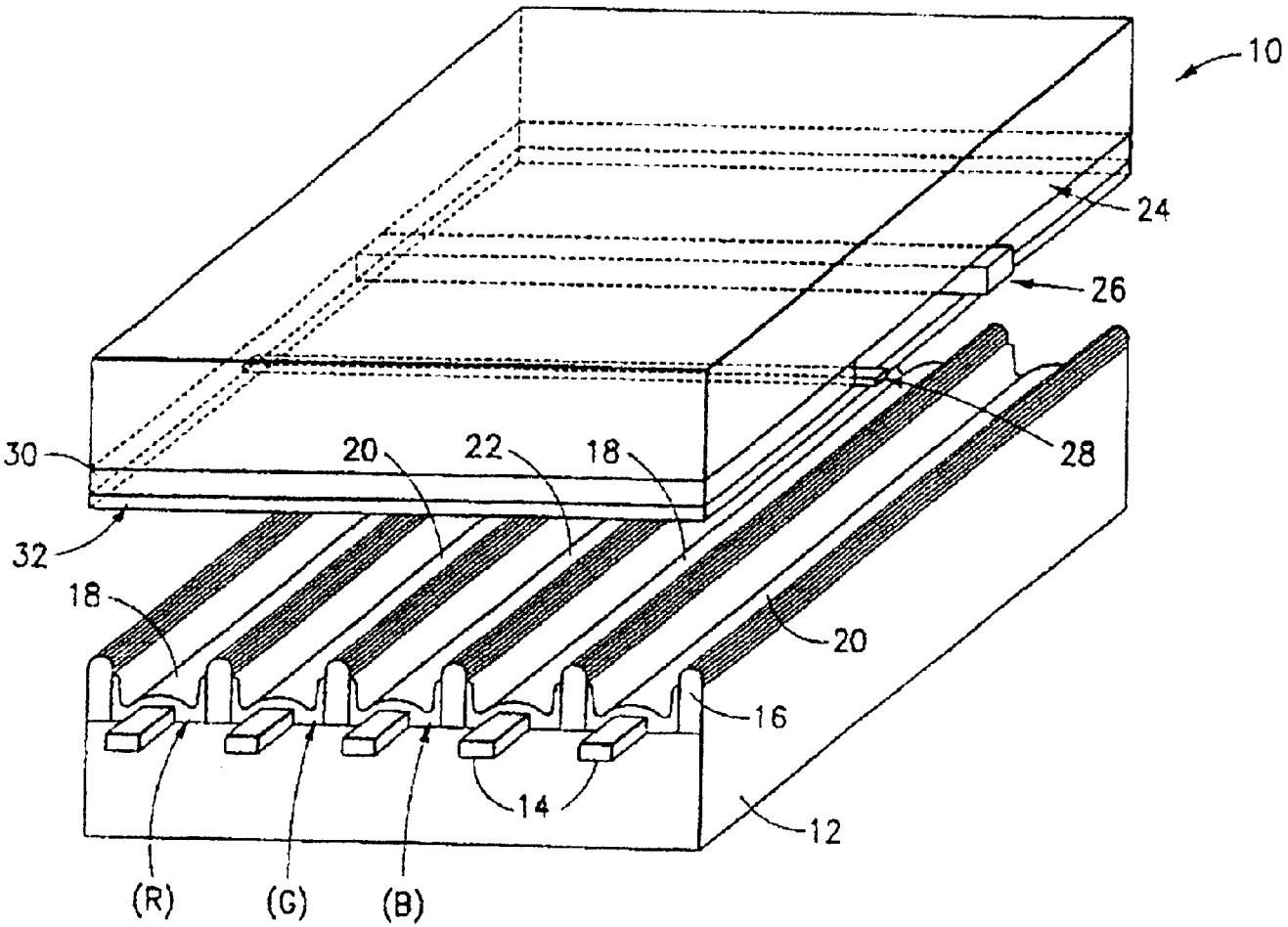
FIG. 1 PRIOR ART
FIG. 1, schematically illustrates a prior art structure of a surface discharge type PDP of the three-electrode type.
Figure 2:
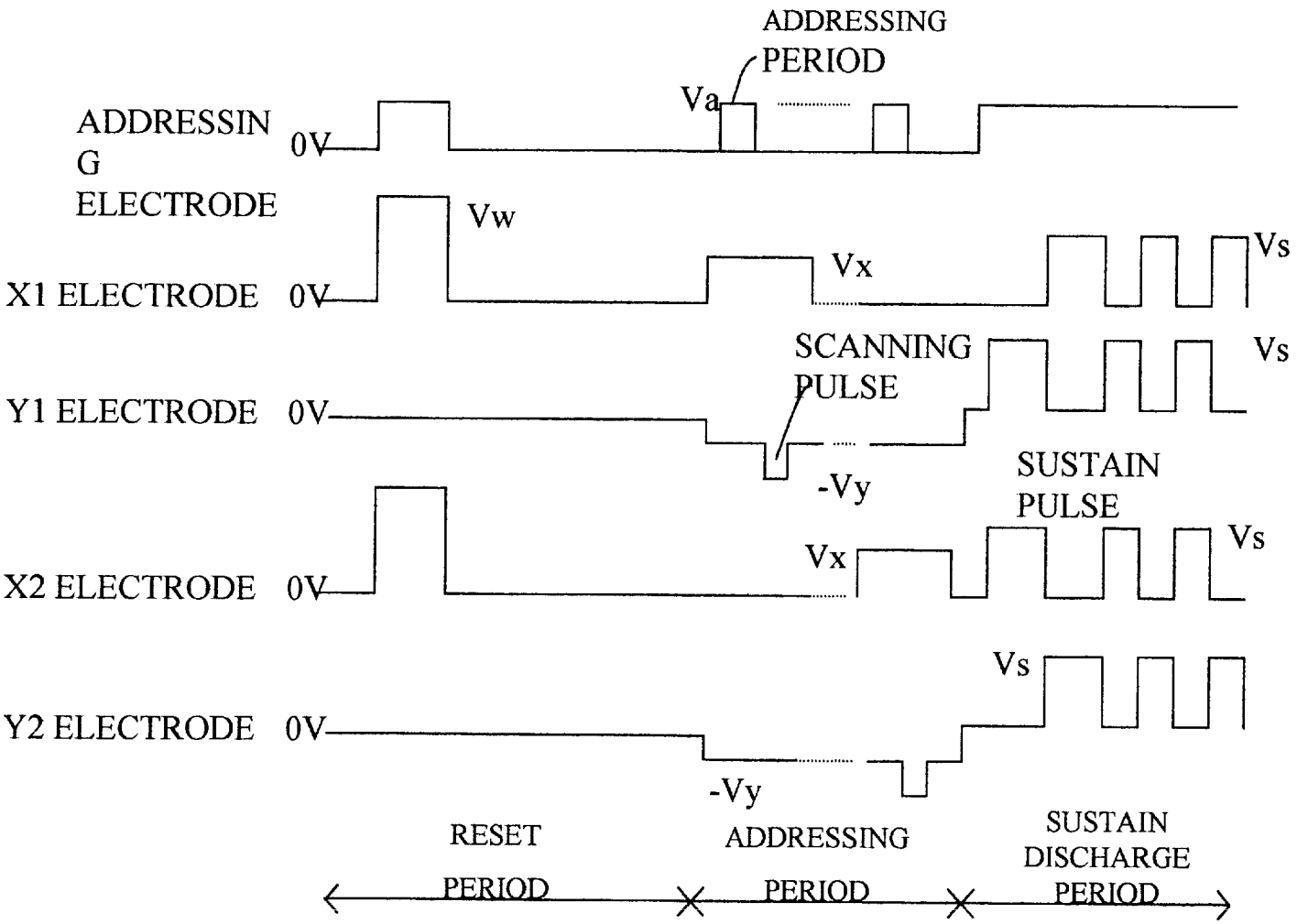
PRIOR ART FIG 2
FIG. 2, is a prior art waveform diagram illustrating a driving method implemented in the PDP shown in FIG. 1.
Figure 3:
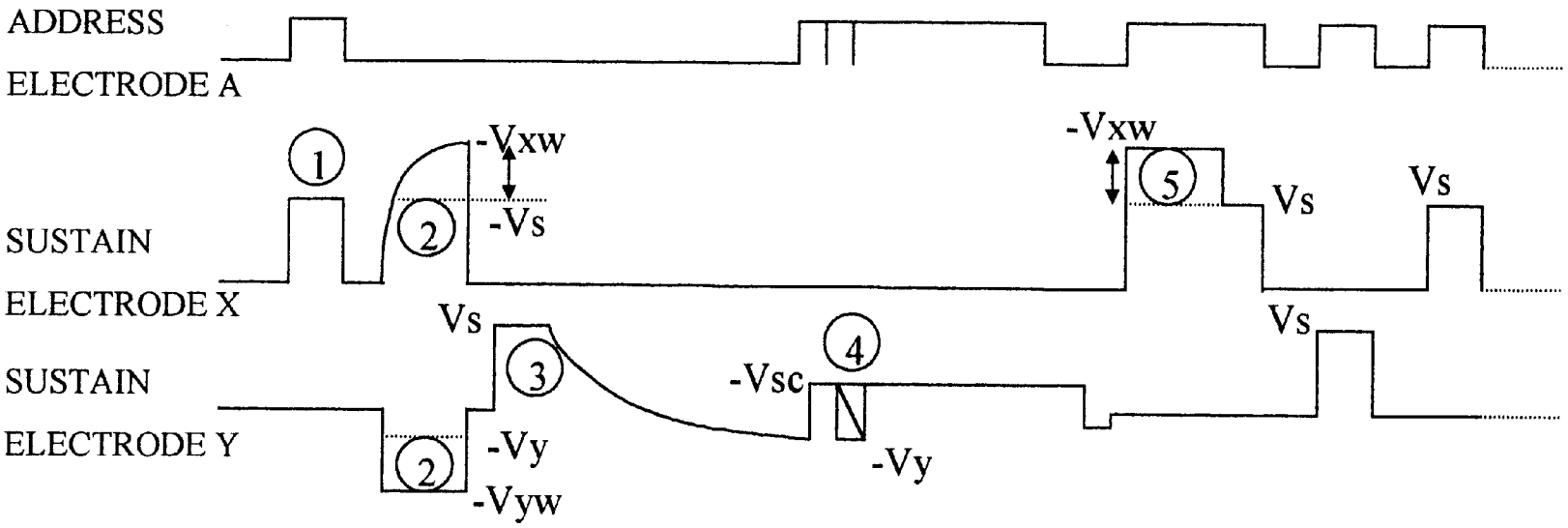
PRIOR ART FIG 3
FIG. 3, illustrates prior art exemplary waveforms of voltage pulses applied to electrodes by the erase address method.
Figure 4:
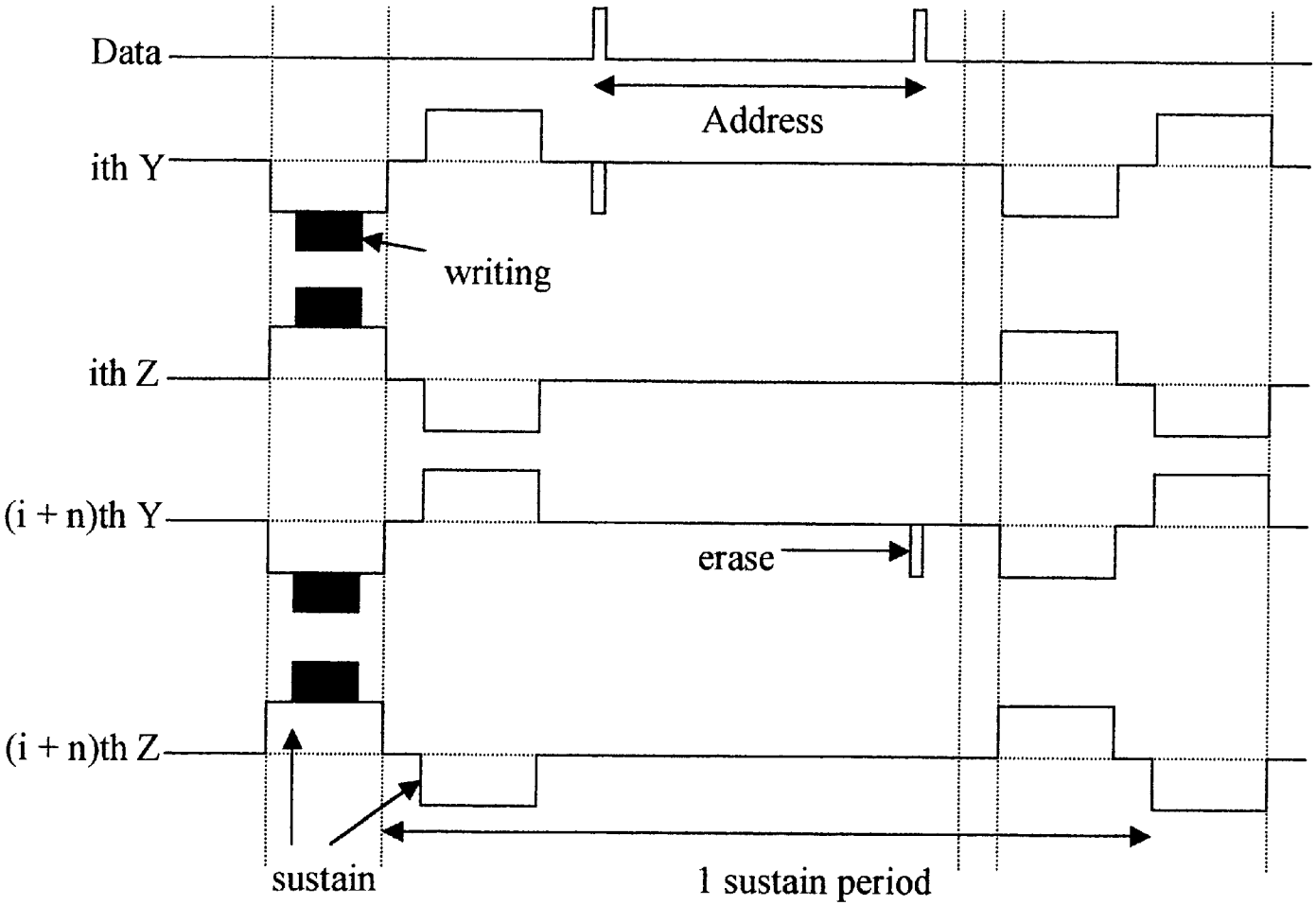
PRIOR ART FIG 4
FIG. 4, illustrates prior art DAS driving waveforms of the AWD type of subfield addressing.
Figure 5:
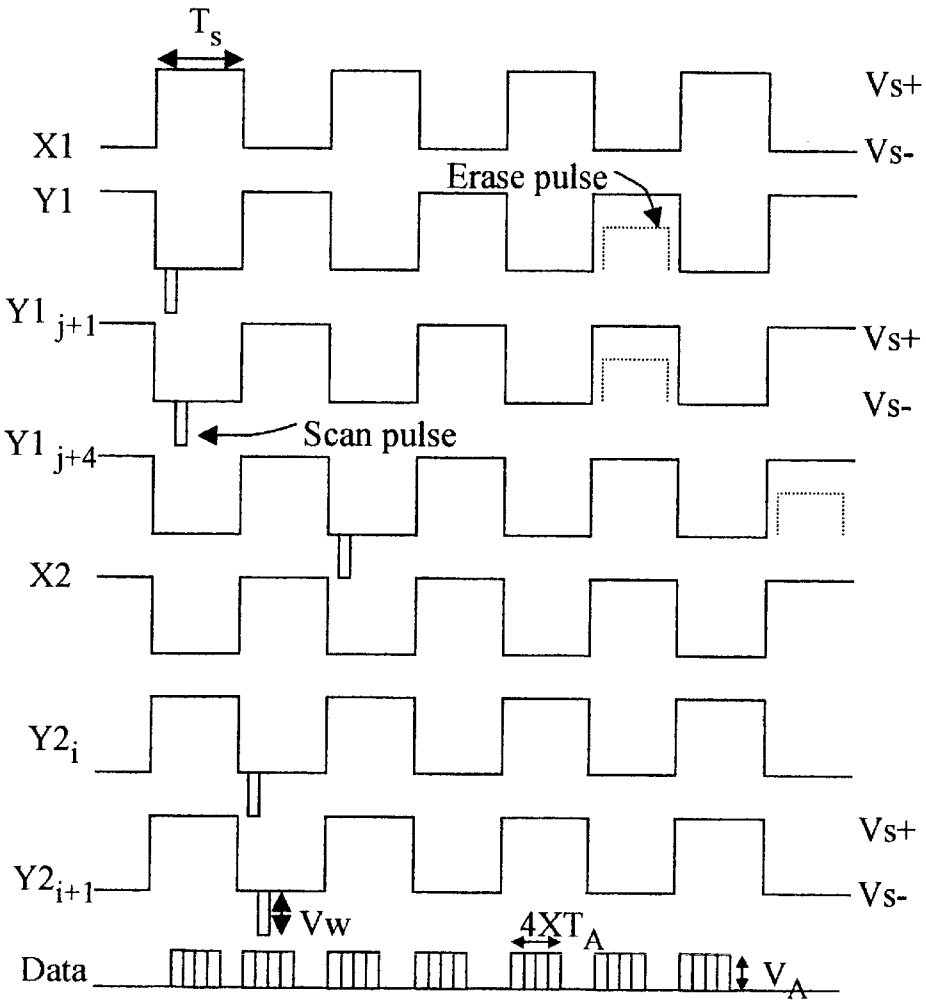
PRIOR ART FIG 5
FIG. 5, illustrates prior art MASS driving waveforms of the AWD type of subfield addressing.

A PDP used in all of the preferred embodiments has the same physical structure as the PDP 10 explained in the related art section of the application and shown in FIG. 1. The panel is structured so that cells also known as a sub-pixels, emitting red, green and blue light are formed at the points where the electrodes groups 26 and 28 cross over or intersect with the address electrodes 14.

Figure 6:
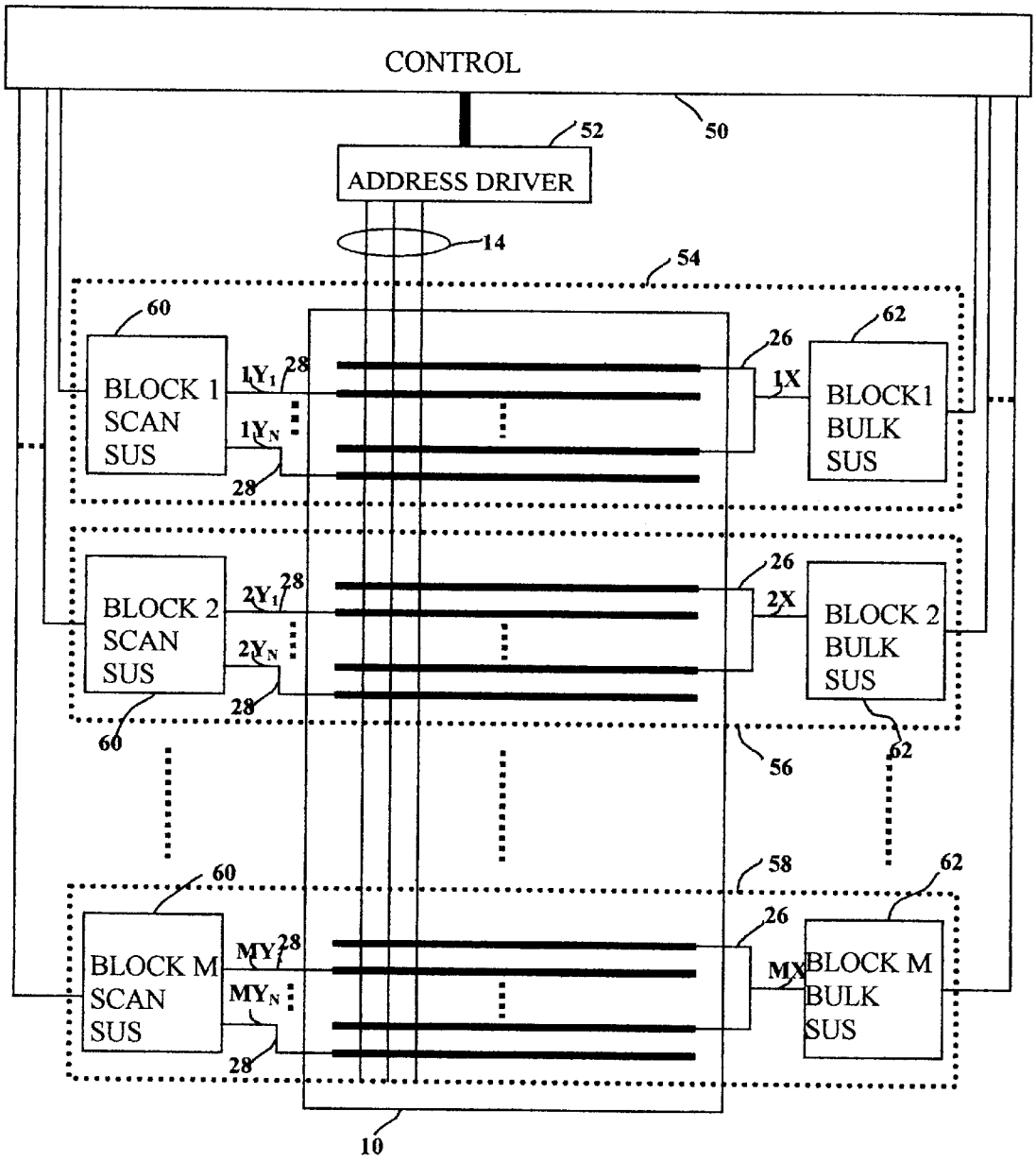
FIG. 6, is a diagram illustrating the structure of a plasma display in accordance with the principles present invention.

The driving method of the embodiments uses the Address Display Together (ADT) method in accordance with the principles of the present invention. Preferably, as shown in FIG. 6, the plasma display panel 10 is divided in display areas, also referred to as blocks, 54, 56, and 58 composed of N lines of Y (28) scan/sustain electrodes and N lines of X (26) bulk sustain electrodes. As used herein "N" refers to a plurality of the items or things. The control circuit 50 supplies all data and control signals to the address driver 52. The output from the address driver to the PDP is to the column data electrodes 14. Control signals from the control circuit 50 to the block scan/sustain circuit 60 enable circuit 60 to generate all the waveforms needed for the Y electrodes 28 operation. Also, output signals from the control circuit enable the bulk sustain circuit 62 to generate all X electrode 26 waveforms.

Figure 8:
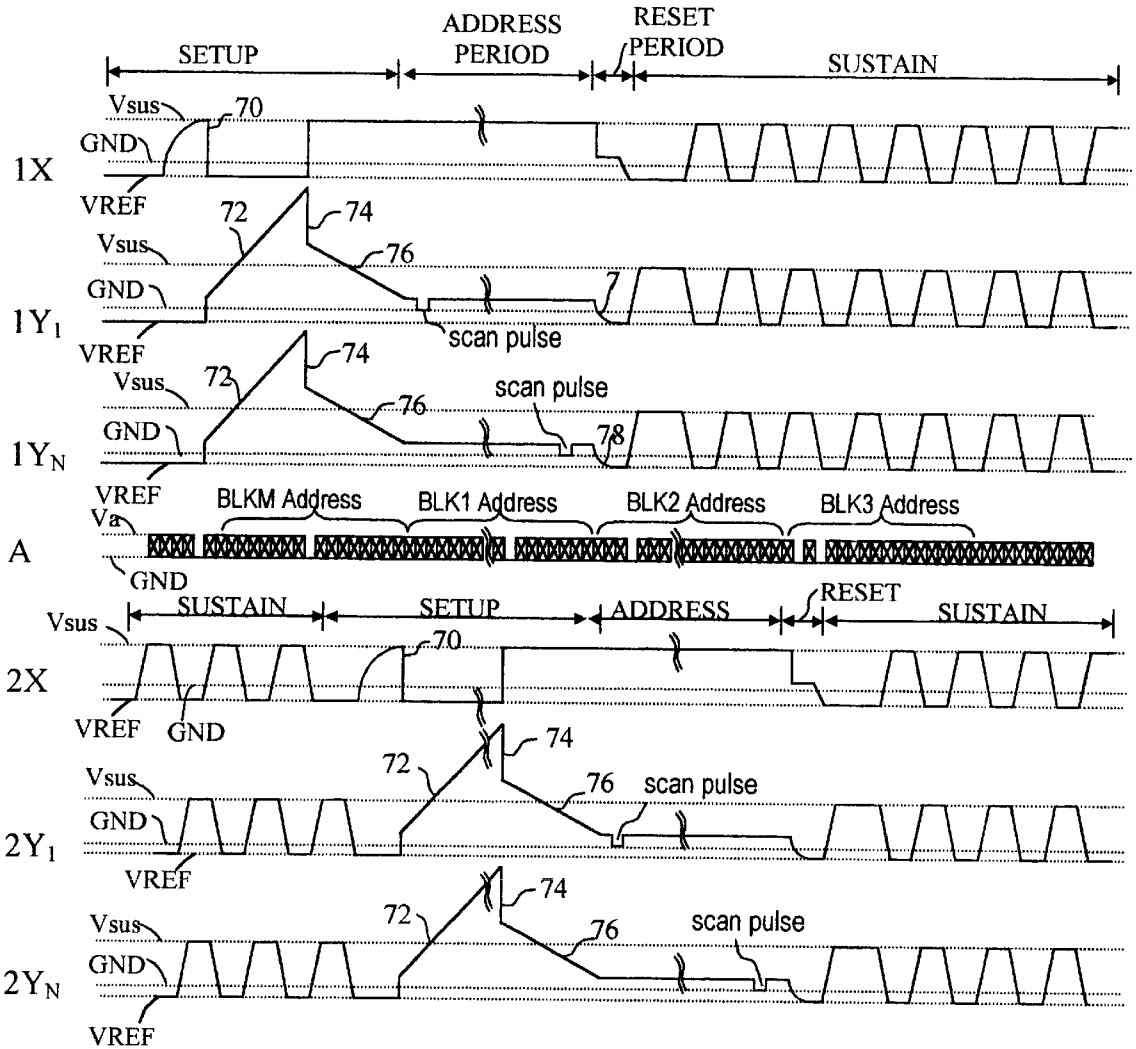
FIG. 8, illustrates exemplary waveforms of voltage pulses applied to electrodes by the ADT method in accordance with the principles of the present invention.

In FIG. 8 there are shown exemplary waveforms of voltage pulses applied to the electrodes of block 1 of the PDP display area 54 and block 2 of the PDP display area 56 of FIG. 6. The drive electronics for each block have independent operation. Therefore the timing of waveforms generated by each block can be different. For example one or more blocks can be in their sustain period producing light emissions, while another block is in its address period and while yet another block is in its setup period.

Referring again to FIG. 8, block 1 area 54 waveforms start with the setup period. Applied to electrode 1X 26 is a panel bulk erase pulse 70, which removes the wall voltage from on cells. After the bulk erase of the PDP a ramp up 72 and a ramp down 76 pulses are applied to the Y scan/sustain electrodes 28. The conditioning of the cell wall voltages in the PDP by the ramp up and down pulses lowers the voltages needed by the address driver 52 for reliable addressing of the PDP. After this area 54 of the PDP has been conditioned the next sequence is the address period. During the address period low row scan pulses are sequentially applied to $1Y_1$ through $1Y_N$ If the data pulses on the address electrodes A (14) are low when the row scan pulse is low, then there is no address discharge, which leaves the cell in an off condition. However, if the data voltage is high when row scan voltage is low, then the address discharge that results establishes a wall voltage in the cell that results in an on condition for that cell. The subsequent wall voltage from this address discharge is latter used by the sustain pulses to enable light emissions.

The wall voltages on off cells must be removed from these cells before the sustain pulses can go to a negative voltage in the sustain period. These are wall voltages, which were put on the cell by the ramp waveforms in the setup period. Otherwise, the off cells will turn on during the first sustain pulse. To accomplish this, a reset period before going into the sustain period is used to remove the wall voltage from off cells. To remove the wall voltage from off cells a negative ramp erase pulse 78 is applied to the Y electrodes 28. This pulse causes a discharge in off cells only, because the off cell wall voltage of the Y electrode has a negative wall voltage and X electrode has a positive wall voltage. Cells that were turned on in the address period have the opposite wall voltage and are not disturbed by the reset period erase pulse 78 and remain ready to enable the subsequent sustain pulses to have light emissions. Removing the wall voltage from the off cells before the sustain period improves the addressing operating margins of the PDP. It also enables using lower addressing voltage such as Va (35v).

Next in the sequence of operation of block 1 area 54 is the sustain period. During this period a series of sustain pulses produce the light emissions of the display. At the start of the sustain period both 1X and 1Y electrodes are at Vref (−65v). The first sustain pulse 1Y (28) electrodes are pulsed positive to Vsus (+115v). This causes a sustain discharge and the wall voltages of the cells to be reversed. For the rest of the sustain discharges the 1Y (28) and 1X (26) electrodes transitions are at the same time. The benefits of having sustain transitions happening at the same time will be explained in more detail later.

Offsetting the sustain pulses to a negative voltage Vref makes possible for the data pulses to remain at a ground reference but still maintain a positive offset of 65 volts when they are referenced to the sustaining electrodes 26, 28. This offset voltage helps prevent discharges from the Y scan/sustain electrode 28 and the X bulk sustain 26 to the data electrode A (14) during the sustain period.

The timing of block 2 is very similar to that of block 1 but its address period cannot start until after block 1's address period has finished. Therefore, the start of block 2's sequence, the setup period, is at a time in block M's address period. This offset of time for different block sequences enables one block to be in an address period while the other blocks are in different sequence periods of display operation.

Data pulses on the data electrode A (14), as illustrated in FIG. 8 are almost continuous. Only being interrupted during times when waveform transitions are not canceled out, such as the time of step down 74 in the setup period.

Starting from the left on A (14) data pulses for block M are at the same time as block 1 is in its setup period and block 2 is in its sustain period. When block 1 is in its address period block 2 is in its setup period. Moving on, when block 2 is in its address period block 1 has completed its reset period and is in its sustain period.

An advantage of the ADT scheme is that during a frame period the time available for line scan addressing is almost 100%. Also, there is more time for the sustain discharge pulses because, unlike the ADS method where the sustain is separate from the address, ADT is addressing and sustaining at the same time. Typically the time for sustain discharge pulses is increased by a factor of three or more over that of the ADS method. Another advantage is that almost all of the present proven line scan addressing schemes can be used for ADT.

Figure 9:
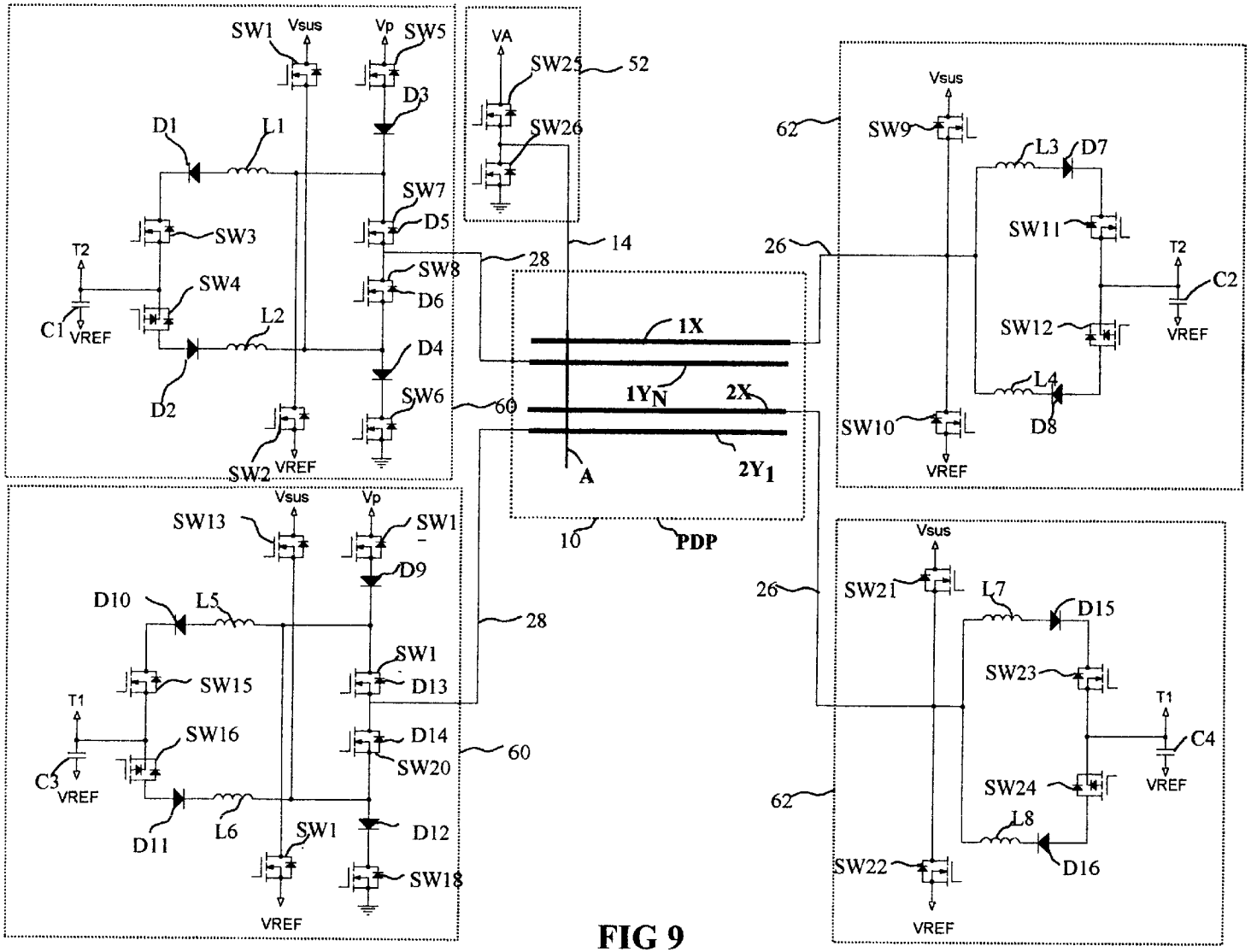
FIG. 9, is a schematic diagram of a drive circuit for two blocks of a plasma display in accordance with the present invention.
Figure 10:
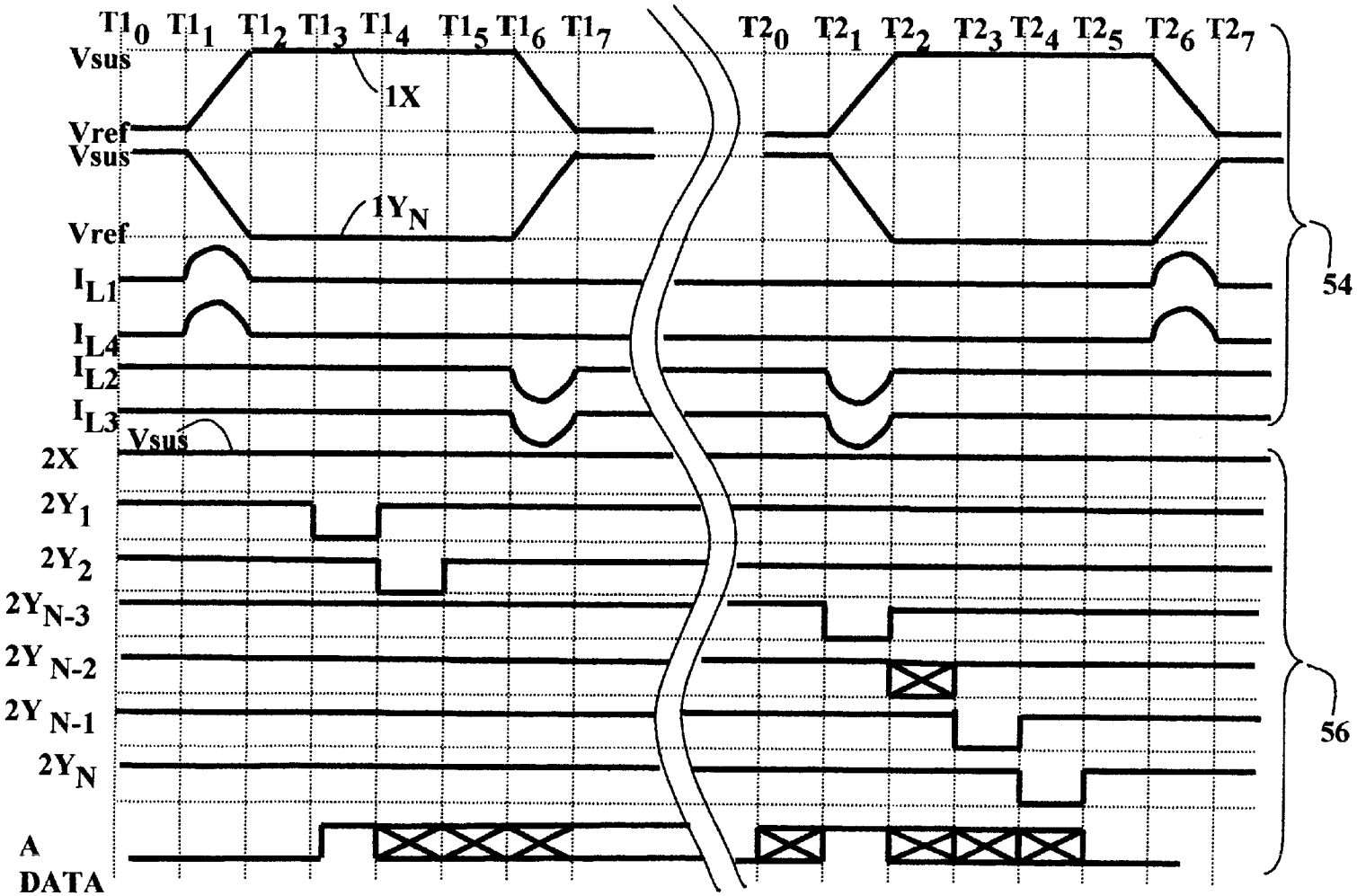
FIG. 10, illustrates the waveforms generated by the drive circuit of FIG. 9.
Figure 11:
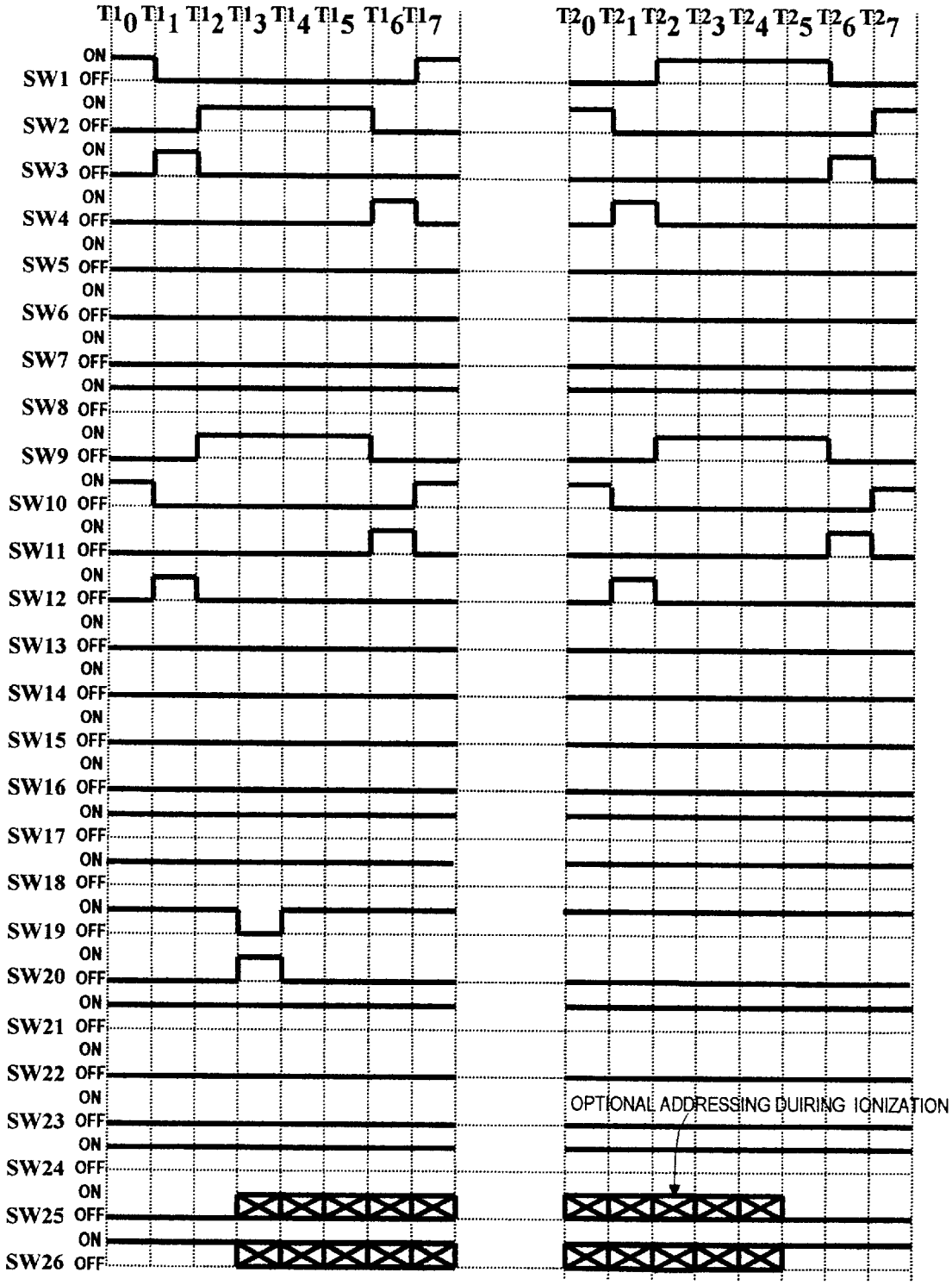
FIG. 11, illustrates the control signals for the circuit of FIG. 9.

As described hereinabove, the ADT method of driving a plasma display panel preferably operates with a panel divided into blocks having independently controlled drive electronics. This makes possible for one display block to have address waveforms, while the remainder of the blocks can have sustain discharge pulses producing light emissions. A circuit that illustrates the drive electronics for two blocks is shown in FIG. 9. Switches SW1 through SW8 generate the 1Y scan/sustain waveform. Switches SW9 through SW12 are used to generate the 1X bulk sustain waveform. Switches SW13 through SW20 generate the 2Y scan/sustain waveform and switches SW21 through SW24 generate the 2X bulk sustain waveform. Switches SW25 and SW26 generate the data pulses on the address electrode A (14). A portion of the waveforms generated by this circuit are illustrated in FIG. 10 and FIG. 11 illustrates the control signals for the switches when generating the waveforms of FIG. 9.

Figure 12:
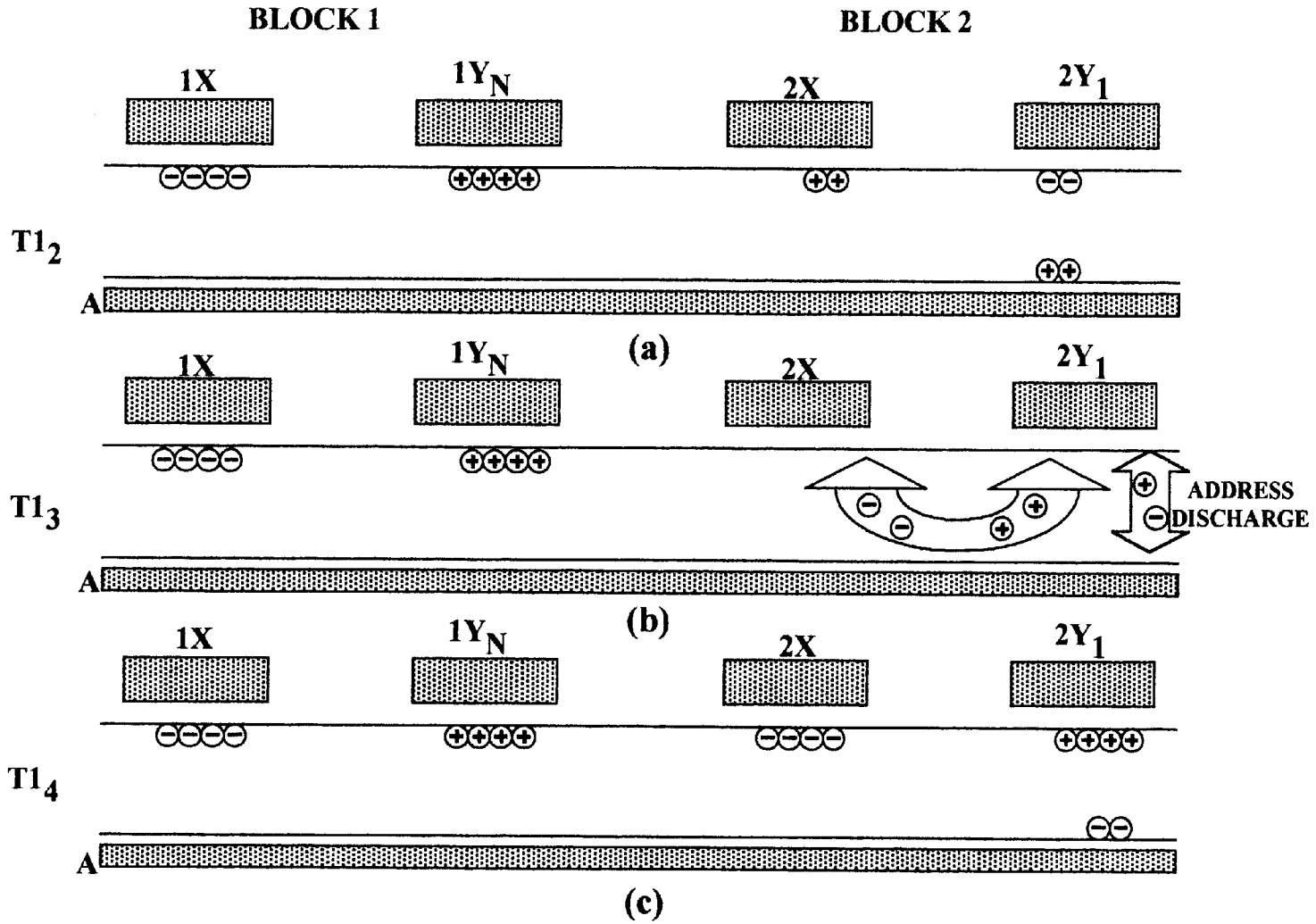
FIG. 12, illustrates an address discharge in the block being addressed and wall voltage of an on cell in the block being sustained.
Figure 13:
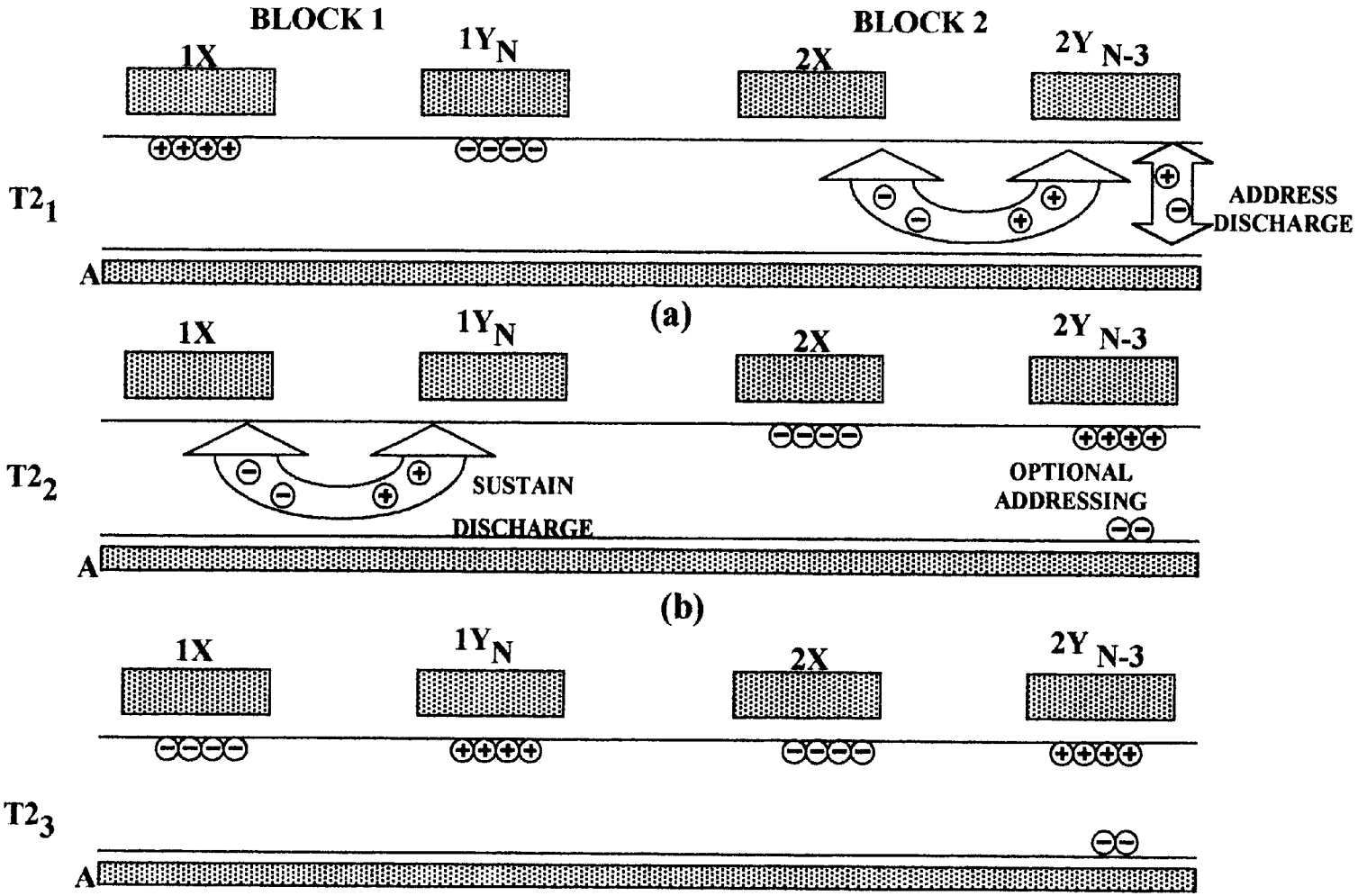
FIG. 13, illustrates an address discharge in the block being addressed and a sustain discharge of an on cell in the block that is being sustained.
Figure 14:
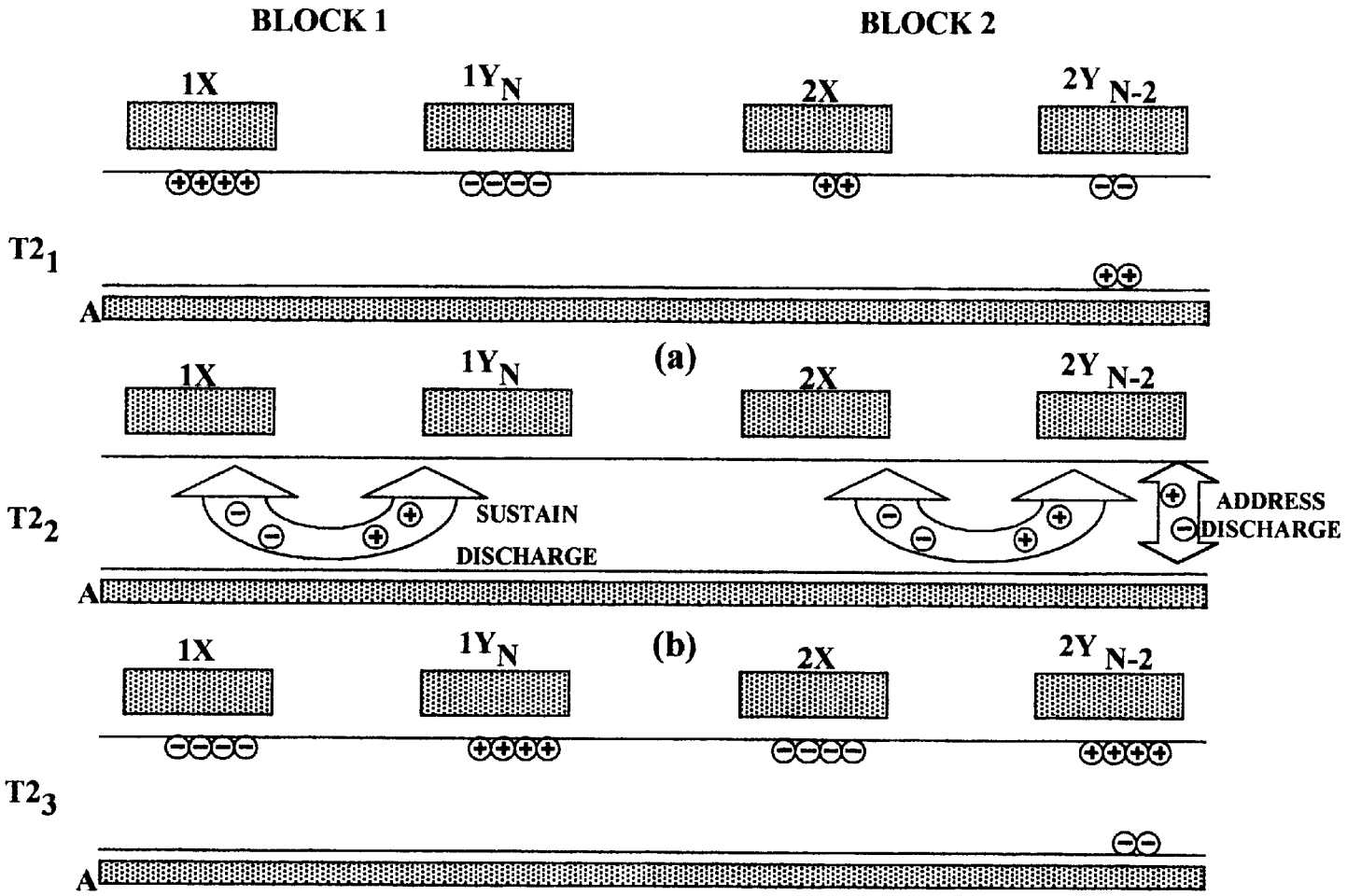
FIG. 14, illustrates address discharge in the block 2, while at the same time a sustain discharge is taking place in block 1.

As illustrated, block 1 area 54 is in the sustain period and block 2 area 56 is in its address period. In FIG. 11 $T1_0$ to $T1_1$ switches SW1 and SW10 are on. As illustrated in FIG. 9, SW1 clamps $1Y_N$ to Vsus and SW10 clamps 1X to VREF. The waveform of FIG. 9, at time $T1_0$ to $T1_1$ shows 1X at VREF and $1Y_N$ at Vsus. Time $T_1$ to $T1_2$ switches SW3 and SW12 are on. This enables the 1X waveform to be rising to Vsus while at the same time the $1Y_N$ waveform is falling to VREF. The transition of both pulses is at the same time, but opposite directions, tends to cancel disturbances to the address electrode A (14). At time $T1_6$ to $T1_7$ switches SW4 and SW11 are on, which causes 1X to fall and $1Y_N$ to rise. $T_7$switches SW1 and SW10 turn on to complete the sustain pulse. The time from $T1_3$ to $T1_4$ has a row scan pulse on $2Y_1$, if the cell is to be on, switches of block 2 56 that are on are SW17, SW18, SW20, SW21 and SW25. The pulses generated on the 2Y, and A (14) data electrode cause an address discharge, which results in wall voltages in the cell. To further illustrate ADT, FIGS. 12 through 14 show sustain and address discharges inside the plasma panel and the resulting wall voltages from these discharges on the plasma panel cells. In FIG. 12*b* an address discharge takes place at time $T1_3$ to $T1_4$ between the $2Y_1$ scan electrode 28 and the column address data electrode A (14). FIG. 12*c* shows the resultant wall voltage on the plasma display cells. FIG. 13*a* illustrates the wall voltage at time $T2_1$ on a cell in block 1, which is the block that has sustain pulses producing light output. An address discharge between A (14) data electrode and $2Y_{N-3}$ is taking place in block 2 during the transitions of the sustain pulses in block 1. Because the pulse transitions are at the same time there effect on the data electrode A is cancelled. FIG. 13*b* illustrates the sustain discharge at time $T2_2$ of an on cell in block 1. During the sustain discharge the addressing in block 2 is stopped. FIG. 13*c* illustrates the resultant wall voltage. FIG. 14*b* illustrates a sustain discharge at time $T2_2$ in block 1, while at the same time an address discharge between A data electrode and $2Y_{N-2}$ is being performed in block 2. FIG. 14*c* illustrates the resultant wall voltages on the cells of both blocks.

Figure 7:
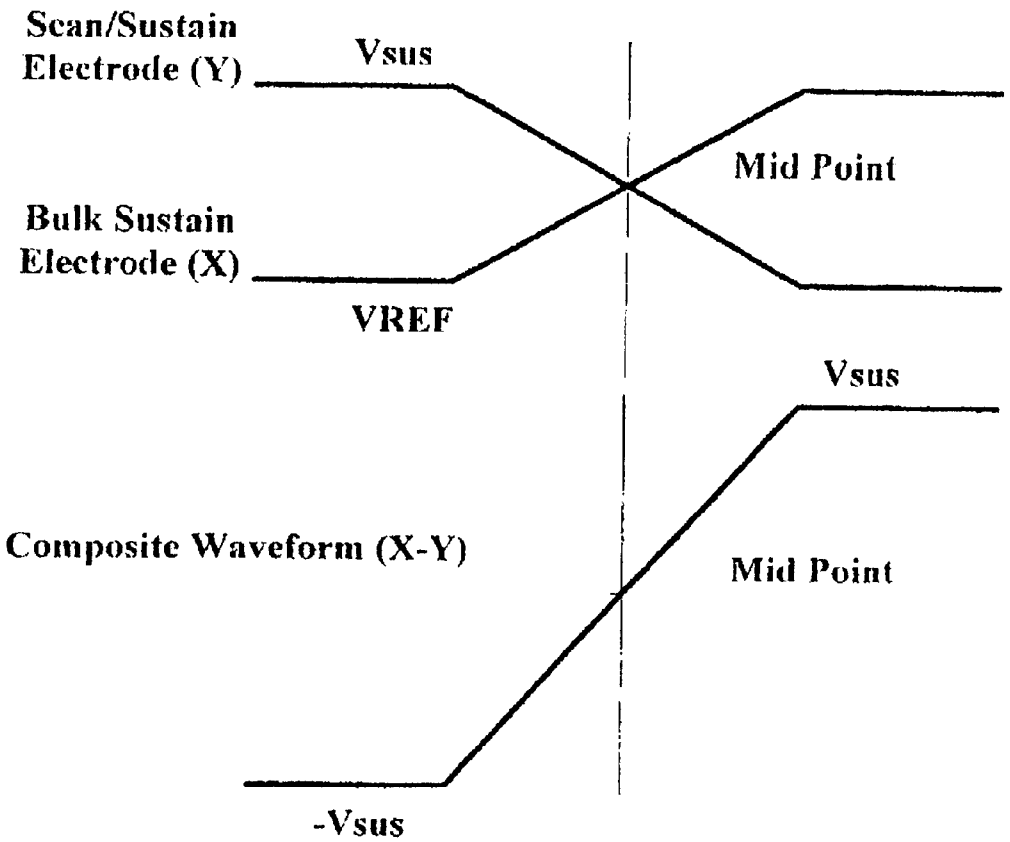
FIG. 7, illustrates waveforms of the sustain discharge pulses crossover showing the timing period and the composite waveform in accordance with the principles of the present invention.
Figure 15:
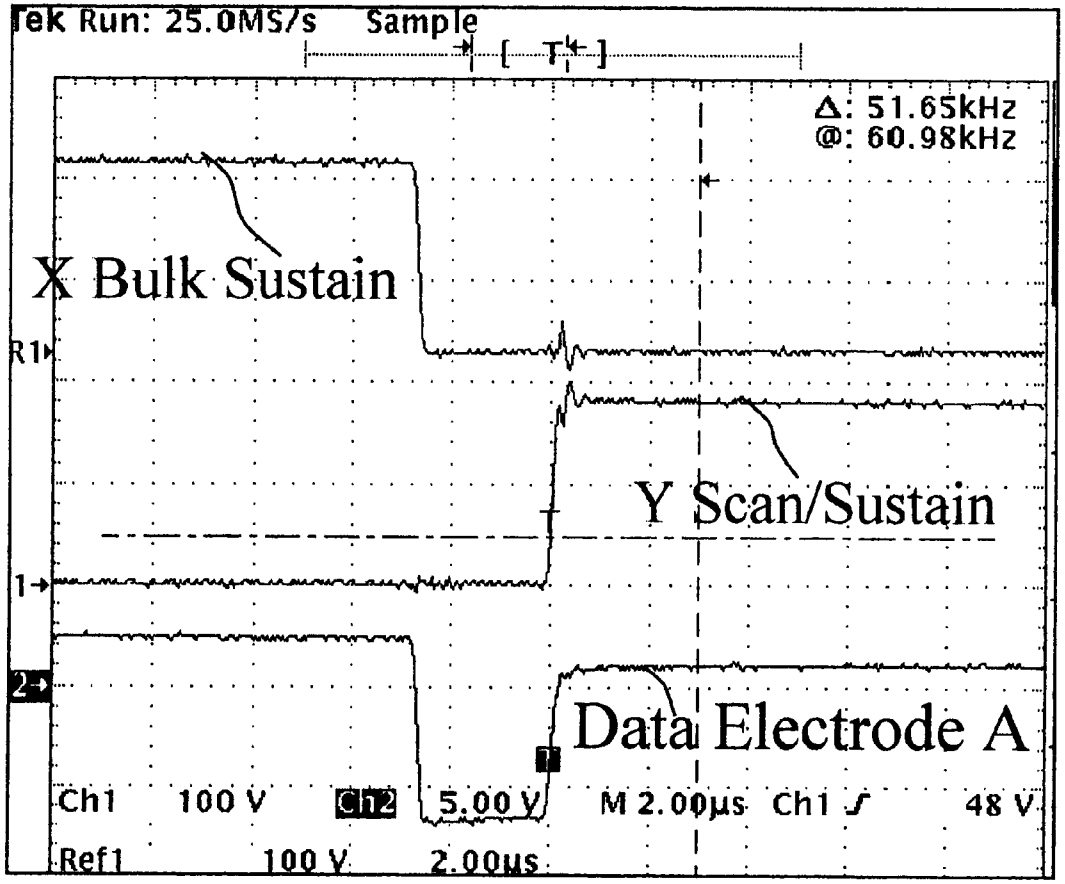
FIG. 15, illustrates the prior art offset sustain waveforms and their effect on the data electrode; and, FIG. 16, illustrates the sustain pulses timing in accordance with the principles of the present invention and the minimum effect on the data electrodes.
Figure 16:
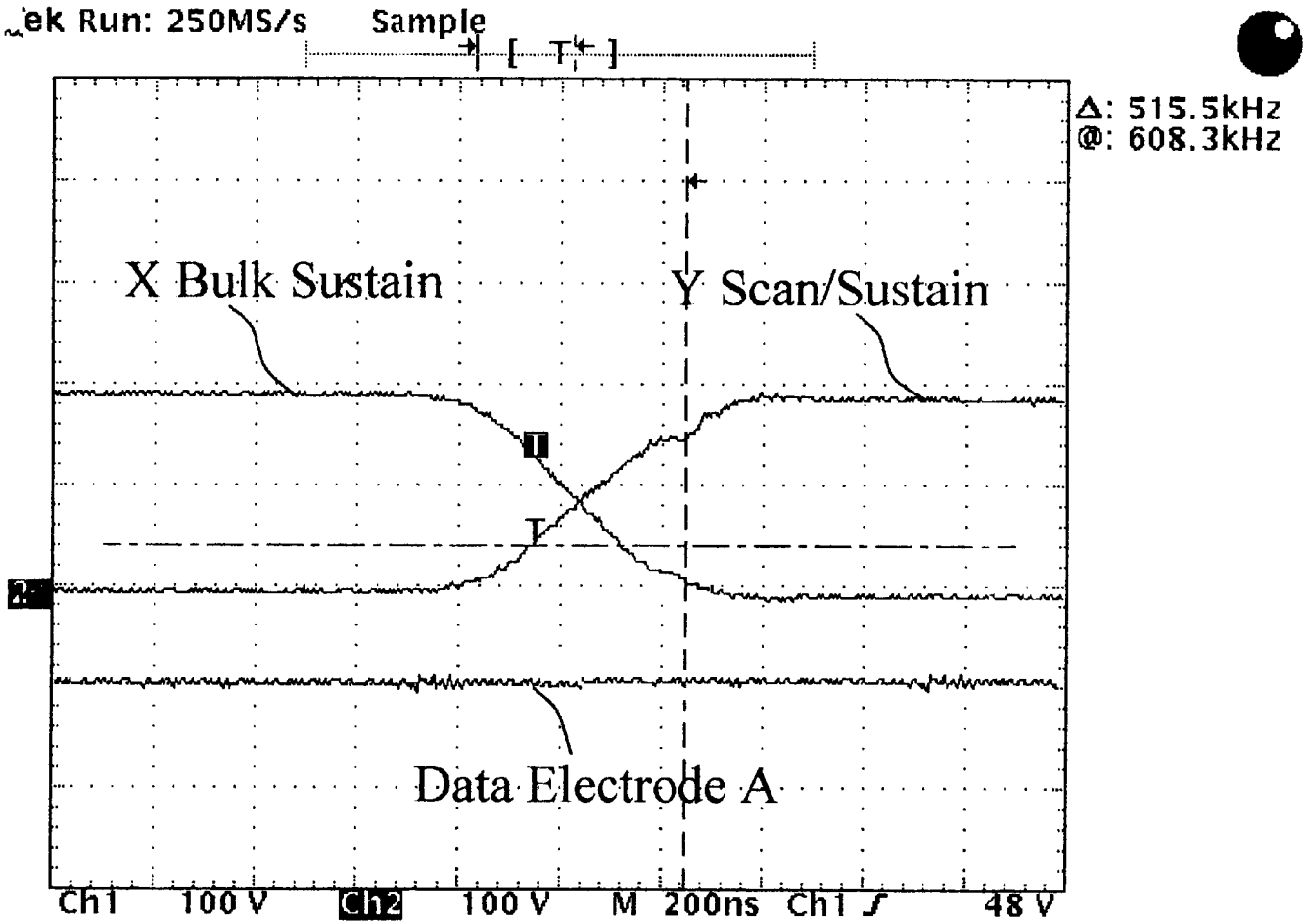

It is noted that the prior art techniques for doing sustain discharge pulses have a delay between pulses such that one pulse is completed before the other starts its transition. As illustrated in FIG. 15, pulses are therefore coupled into the data electrode during sustain transitions. On the other hand, FIG. 7 is a waveform relating to the present embodiment according to the present invention that is used to eliminate this effect. The scan electrode waveform and the sustain electrode waveform transitions are in the same time period. Additionally, as best illustrated in FIG. 7, the scan electrodes 28 and sustain electrodes 26 are simultaneously driven between low and high electrical potentials or at opposite phase with respect to one another. This prevents interference on the address electrodes 14 or essentially cancels the effective induced electrical potential experienced on the address or data electrodes 14. As shown in the FIG. 16, the actual effect upon the data electrode is very small and can be said that substantially no electrical potential is induced on the address electrodes 14. In view of this, as described herein, electrical potentials or pulses can be placed on the address electrodes 14 for thereby addressing certain rows of cells while, simultaneously, other single or groups of rows such as display areas 54, 56 are being driven to sustain discharges or are being conditioned for addressing. An additional benefit of having sustaining waveforms that crossover each other is that rise and fall times typically have twice the time period as what sustaining waveforms with a delay between pulses have. This should help reduce the stress on drive components, which affects cost and reliability. Also, the slower slope waveform should help reduce EMI.

It is further noted that it is necessary to maintain a positive offset voltage on the data electrodes A (14) which prevents discharges from the scan/sustain 28 and bulk sustain electrodes 26 pulses to the data electrodes A (14). However, it is very helpful to have the data driver IC's referenced to ground. In FIG. 8 there are provided waveforms showing the offset of voltage relating to the present invention. The low level of the sustain discharge pulse VREF (−65v) is negative with respect to the ground based data driver IC's. This enables the data driver IC's to keep a ground reference, but have a positive offset voltage in relation to the sustain discharge pulses, no matter if the data output voltage Va is low or high.

As should now be evident in the ADT method of plasma display drive, one block of the display is being Addressed while the remaining blocks can have sustain pulsed producing light emissions. Because, during a frame there is always one block of the display being address scanned, the result is almost 100% address time. Additionally, the sustain time is increased because all blocks of the display can have sustain pulses producing light emissions except the one block being addressed.

Also, because each block is under separate control, sustain pulses of each block can be offset such that the sustain transitions of all blocks are at a different time. This results in a decrease of peak currents in the PDP that is correlated to the number of blocks being sustained at a given time.

While the invention has been described as having specific embodiments, it will be understood that it is capable of further modification. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. A method of driving a plasma display panel having a plurality of pairs of first and second electrodes arranged parallel with one another and third electrodes arranged generally orthogonal to said first and second electrodes, a plurality of cells defined at cross points of said electrode pairs and third electrodes, wherein sustain discharges are provided in said cells by changing the electrical potential of said first and second electrodes with respect to one another, said method comprising the steps of:

simultaneously driving the first and second electrodes of at least one pair between low and high electrical potentials with respect to one another, whereby sustain discharges are provided at one or more cells of said one pair and substantially no electrical potential is induced on said third electrodes.

2. The method of claim 1 further comprising the step of placing an electrical potential on said third electrodes while simultaneously driving the first and second electrodes of at least one pair between low and high electrical potentials with respect to one another, whereby address charges are placed on cells of another pair of electrodes while sustain discharges are provided on one or more cells of said a least one pair of electrodes.

3. The method of claim 1 wherein said pairs of electrodes are separated into at least two display areas and wherein, while first and second electrodes of a first display area are being simultaneously driven between low and high electrical potentials with respect to one another, electrical potentials are placed on said third electrodes and address charges are placed on cells of the pairs of electrodes of a second display area.

4. The method of claim 1 wherein said first and second electrodes of said at least one pair are switched substantially simultaneously for changing electrical potential, and the rate of electrical potential change of each said first and second electrodes are substantially the same but in opposite direction.

5. The method of claim 4 wherein the transition between said low and high electrical potentials on each of said first and second electrodes occurs in a period greater than 300 ns.

6. A method of driving a plasma display panel having a plurality of pairs of first and second electrodes arranged parallel with one another and third electrodes arranged generally orthogonal to said first and second electrodes, a plurality of cells defined at cross points of said electrode pairs and third electrodes, wherein sustain discharges are provided in said cells by changing the electrical potential of said first and second electrodes with respect to one another, said method comprising the steps of:

simultaneously driving the first and second electrodes of at least one pair substantially at opposite phase and between low and high electrical potentials with respect to one another, whereby sustain discharges are provided at one or more cells of said one pair and substantially no electrical potential is induced on said third electrodes.

7. The method of claim 6 further comprising the step of placing an electrical potential on said third electrodes while simultaneously driving the first and second electrodes of at least one pair at opposite phase and between low and high potentials with respect to one another, whereby address charges are placed on cells of another pair of electrodes while sustain discharges are provided on one or more cells of said at least one pair of electrodes.

8. The method of claim 6 wherein said pairs of electrodes are separated into at least two display areas and wherein while, first and second electrodes of a first display areas are being simultaneously driven at opposite phase and between low and high electrical potentials with respect to one another, electrical potentials are placed on said third electrodes and address charges are placed on cells of the pairs of electrodes of a second block.

9. The method of claim 6 wherein said first and second electrodes of said at least one pair are switched substantially simultaneously for changing electrical potential and the rate of electrical potential change of each said first and second electrodes are substantially the same but in opposite phase and direction.

10. The method of claim 9 wherein the transition between said low and high electrical potentials on each of said first and second electrodes occurs in a period greater than 300 ns.

11. A method of driving a plasma display panel having a plurality of pairs of first and second electrodes arranged parallel with one another and third electrodes arranged generally orthogonal to said first and second electrodes, a plurality of cells defined at cross points of said electrode pairs and third electrodes, wherein electrical potential is placed on said first or second electrodes for conditioning said cells for addressing with said third electrodes, said method comprising the steps of:

conditioning cells of at least one pair by placing electrical potential on said first or second electrodes of said one pair; and, while conditioning said cells in said one pair, placing an electrical potential on said third electrodes, whereby address charges are placed on cells of another pair of electrodes.

* * * * *